United States Patent [19]

Evans

[11] 4,127,043

[45] Nov. 28, 1978

[54] ROCK BIT WITH WELDED BEARING PINS

[75] Inventor: Robert F. Evans, La Habra, Calif.

[73] Assignee: Smith International, Inc., Newport Beach, Calif.

[21] Appl. No.: 807,450

[22] Filed: Jun. 17, 1977

[51] Int. Cl.[2] ..... E21B 9/08

[52] U.S. Cl. ..... 76/108 A; 175/369

[58] Field of Search ..... 175/369, 366, 412, 413, 175/375, 332; 308/8.2; 76/101 R, 101 A, DIG. 5, 101 E; 219/148

[56] References Cited

U.S. PATENT DOCUMENTS 2,076,002 4/1937 Reed ..... 308/8.2

3,850,256 11/1974 McQueen ..... 175/375

4,043,411 8/1977 Lichte ..... 76/108 A

FOREIGN PATENT DOCUMENTS 1,014,046 8/1957 Fed. Rep. of Germany ..... 175/366

*Primary Examiner*—Harold D. Whitehead

*Assistant Examiner*—Roscoe V. Parker

*Attorney, Agent, or Firm*—Christie, Parker & Hale

[57] ABSTRACT

A rock bit and manufacturing method wherein journal-bearing pins which support rotatable cutters on the bit body are separately machined and heat treated, and then mounted on the bit body by electron-beam welding or a related process of energy-beam bonding.

7 Claims, 3 Drawing Figures

ROCK BIT WITH WELDED BEARING PINS

BACKGROUND OF THE INVENTION

Rotary rock bits are used to bore earth formations in the drilling of oil and gas wells, geothermal steam wells, and the like. Typical modern rock bits have a main body which is a welded assembly of several (usually three) mating segments or legs. An upper end of the welded legs is machined to form threads enabling attachment of the bit to the lower end of a drill pipe used in conventional rotary drilling. Drilling mud is circulated through the drill pipe and passages in the bit body to cool the bit, and to flush cuttings to the surface through an annulus between the drill pipe and well bore above the bit.

A rotatable cutter is mounted at the lower end of each leg, and the cutters are usually conical in shape and hence called cones. Depending on the type of formation to be drilled by the bit, the cones may have integrally formed teeth, or may be fitted with hard inserts of sintered tungsten carbide or the like. The cone interior has a cylindrical bore which receives a bearing shaft or pin extending from the associated bit leg. The cone is secured against axial movement off the pin by a locking means such as a set of balls fitted into a mating race defined by aligned annular grooves in the cone and pin. These structural features are conventional, and are well known in the art.

Two fundamental objectives in rock-bit design are to provide bits which will drill an accurate hole of controlled diameter, and which will drill the greatest possible depth of earth formation at an acceptable penetration rate before replacement is required due to bit wear. Hole diameter accuracy must be maintained to avoid pinching and time-consuming reaming when the next bit is moved into the hole, and also to insure that the hole is of proper size to receive casing pipe and the like. Bit life and drilling performance are of economic importance because rotary drilling rigs are expensive to staff and maintain, and many hours of unproductive down time are required to pull a worn bit and insert a replacement.

Rock bits operate under heavy loads, and are subjected to high temperatures and an abrasive environment. These tools are accordingly made of high-strength alloys and may incorporate pressure-compensated lubrication systems. Particular attention is given to the bearing structures used to support the cones on the bit-leg pins. Anti-friction bearings are used in some bit styles, but many modern bits intended for heavy service use a journal bearing to transmit loads from the rotating cutter cones to the bit body.

An overall goal in rock-bit design is to provide subsystems (bearings, lubrication, seals, etc.) which will outlast the cutting surfaces of the cones. Achievement of this objective insures that ultimate bit life will be determined by wear of the cutting surfaces, rather than by failure of a subsystem which requires premature replacement of a bit with cutting surfaces capable of further drilling.

In conventional bits, each bit-body segment or leg and bearing pin is a unitary integral body of high-strength steel which is forged and subsequently machined to final shape. Lubrication passages and openings for drilling — mud jets and the like are machined in the legs, and the cones are installed on the legs prior to final assembly (welding of the legs) because the cones are closely meshed and cannot be mounted after the legs are assembled. The legs are precisely mated to insure that the final bit will have the proper gage (hole size) diameter, and the legs are then welded to form the bit body.

This invention is directed to a non-integral two-piece leg wherein the bearing pin is separately machined and then welded to a lower part of the leg structure. The broad concept of a two-piece leg is known, and welded bearing pins and related arrangements are shown in U.S. Pat. Nos. 1,874,065, 2,039,551, 2,058,155, 2,321,484, 2,329,751 and 2,654,577. The welded surfaces in these prior-art designs, however, were formed by conventional arc or gas welding methods which have low penetration, and which leave a relatively large heat-affected zone in the metal adjacent the weld. This in turn results in warping and a detrimental effect on the properties of heat-treated alloys, and modern bits are accordingly made with integrally forged legs and bearing pins.

The problems encountered in prior-art welded bits are substantially overcome by using electron-beam welding methods to attach a separately machined and heat-treated bearing pin to the associated bit leg. As explained in greater detail below, bits made according to the invention can be produced at lower cost without sacrifice of dimensional accuracy or mechanical strength, and significant energy savings arise from the ability to limit certain heat-treating processes to the bearing pin alone. Electron-beam welding for assembly of other portions of rock bits is known, and is discussed in U.S. Pat. Nos. 3,850,256, 3,907,191, and 3,987,859.

BRIEF SUMMARY OF THE INVENTION

Briefly stated, this invention relates to a leg-segment assembly for a rock bit, and a method for making the assembly. The assembly includes a leg which has an upper shank portion adapted to mate with similar legs to form the main body of a rock-bit assembly, and which has a lower shirttail portion depending from the main body and defining a bore to receive a non-integral separate bearing pin which may be a different alloy than the alloy forming the leg. The bearing pin has a base portion configured to fit in the shirttail bore, and substantially the entire mating surfaces of the pin and shirttail are welded together by an energy-beam welding method which is preferably electron-beam welding.

In a preferred form, the bearing pin has a radially extending annular flange at an inner end of the base portion, and the flange abuts an inner surface of the leg shirttail. The leg seat preferably extends entirely through or across the leg shirttail, and in one form is a cylindrical bore mating with a cylindrical surface forming the base portion of the bearing pin. The electron-beam weld head penetrates into the flange which can be machined off after welding. Preferably, an outer end of the pin base portion generally conforms to the contour of the adjacent shirttail outer surface, and the outer end extends slightly beyond the shirttail surface prior to welding and final machining.

DESCRIPTION OF THE PREFERRED EMBODIMENT

Figure 1:
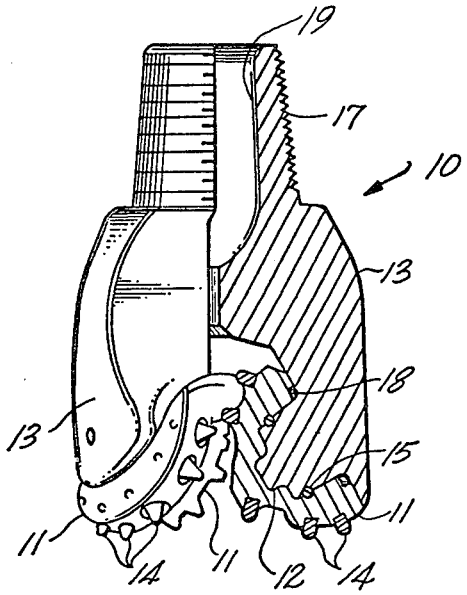
Fig. 1 PRIOR ART
FIG. 1 is an elevation, partly in section, of a conventional prior-art rock bit with legs having integral bearing pins.

A typical rock bit 10 of a prior-art style is shown in FIG. 1. The bit shown in the drawing is a three-cone bit, but it is to be understood that bits with other numbers of cones are well known in the art, and the invention to be described in detail below is equally applicable to such bits.

Bit 10 includes three cone-shaped cutters 11 which are mounted bearing pins 12 integrally formed on each of three bit segments or legs 13 which make up the bit. Pins 12 are illustrated as journal bearings, but the invention is equally applicable to pins configured to receive rollers, balls, or similar anti-friction bearing elements. Each cutter 11 may have milled teeth (not shown), or may carry a plurality of sintered-tungsten-carbide inserts 14 suitable for drilling hard formations. The cones are retained on pins 12 by conventional locking balls 15 which are fed into a race through a ball passage (not shown) after the cutters are mounted as is well known in the art.

A pin end 17 at the upper end of the bit remote from cutters 11 is threaded for attachment to a rotary drill pipe (not shown). Each cutter and leg may be provided with a conventional lubrication system which is omitted from the drawings for clarity. The lubrication system supplies grease to the bearing surfaces, and grease seals 18 are provided between the cutters and bearing pins to prevent loss of lubricant.

A central interior portion 19 at the upper end of the bit is hollow and communicates with passages in the bit legs leading to openings or jet orifices above the cutter. Drilling mud is pumped from the surface through the drill pipe to flow over the cutters and carry rock particles back to the surface through the annulus around the bit and drill-pipe string. The features described thus far are conventional, and, for brevity, will not be described in greater detail.

The conventional manufacturing method used to make each leg 13 is to forge a body of alloy steel to roughly the shape of the desired part, and then to perform a variety of machining operations to bring the leg and integral pin to final shape. The part is also selectively carburized and heat treated to provide necessary strength and abrasion resistance. High strength and durability are particularly important for the bearing pin which is subjected to very heavy axial and radial loads by the rotating cone during drilling operations.

Figure 3:
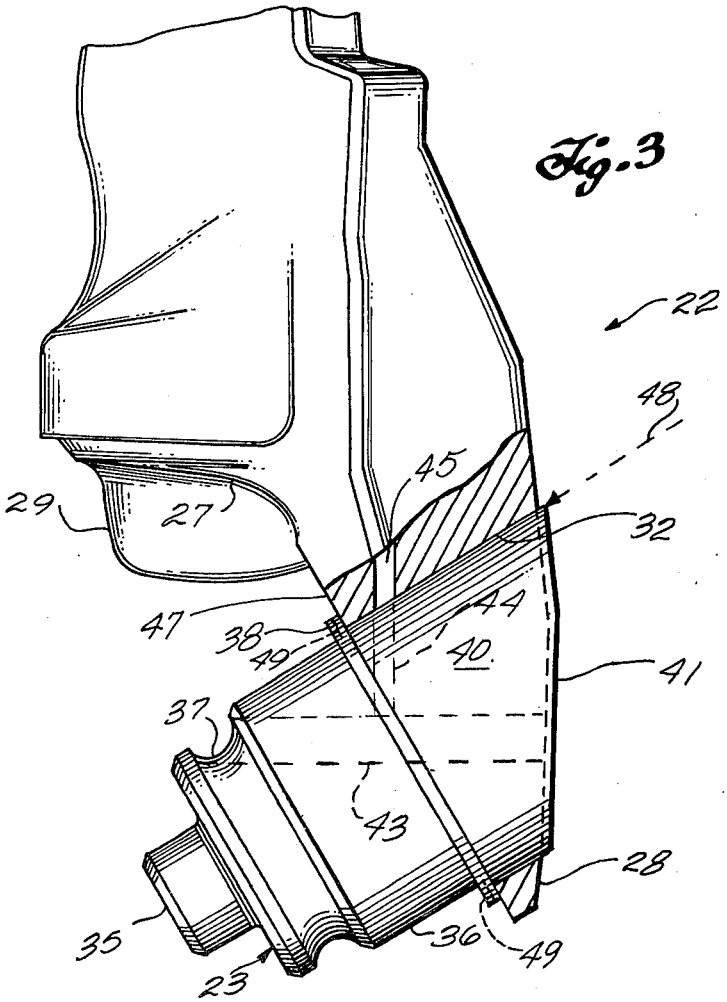
FIG. 3 is an elevation, partly in section, of the assembled leg and pin.
Figure 2:
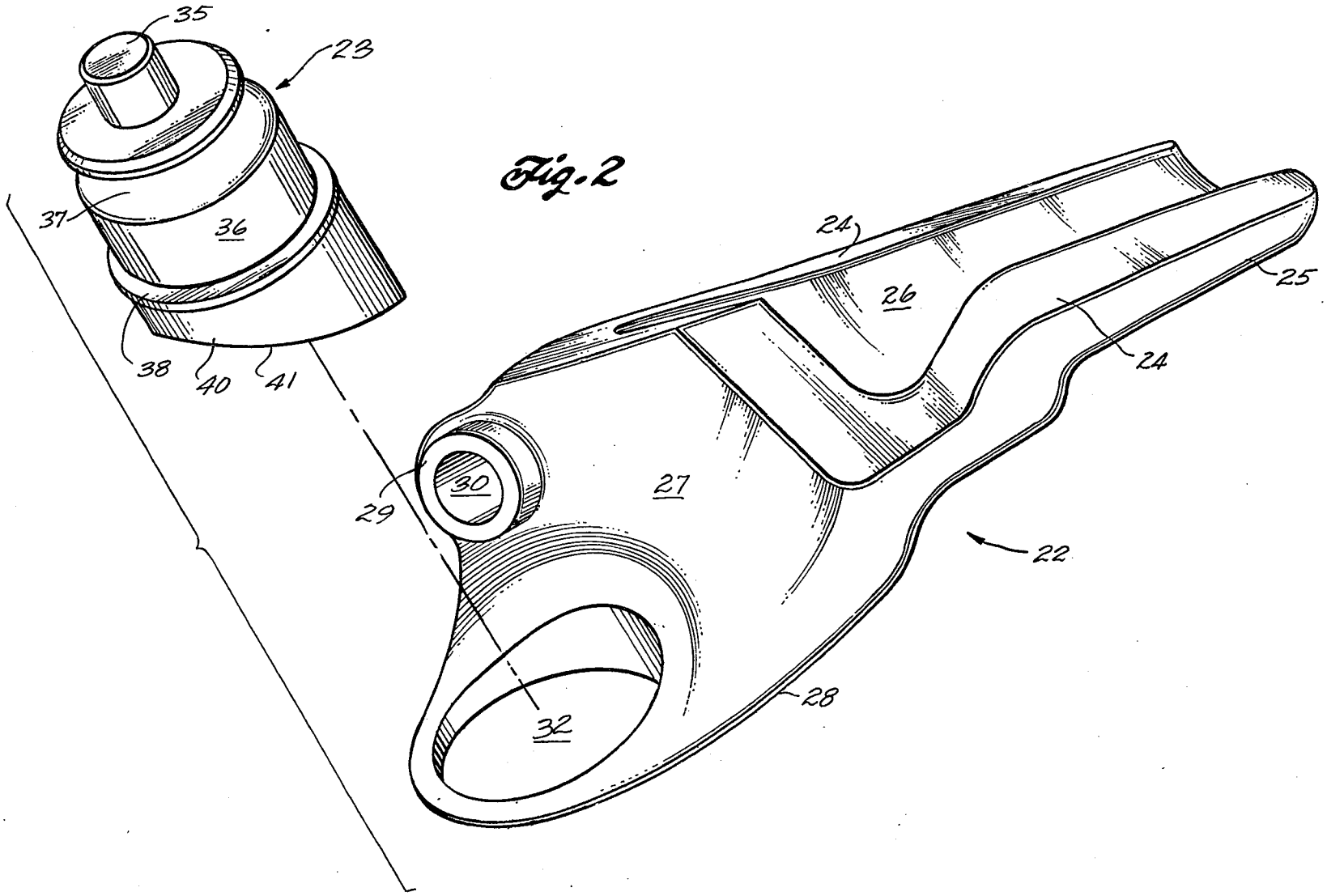
FIG. 2 is a pictorial view of a rock-bit leg and bearing pin suitable for use with the method of this invention.

An improved rock-bit leg 22 and separate journal-bearing pin 23 suitable for use with the method of this invention are shown in FIGS. 2 and 3. The upper part of the leg is conventional, and has a pair of angularly oriented flat surfaces 24 which extend longitudinally along a shank portion 25 of the leg. The flat faces are normally oriented at an angle of 120° to each other so the three legs commonly used to form a complete rock bit will fit together tightly when assembled for final welding.

An inner surface 26 of the leg shank portion is concave to form a passage for drilling mud similar to portion 19 shown in FIG. 1. A concave domed surface 27 extends downwardly and outwardly from flat surfaces 24 to a tapered lower end of the leg called a shirttail 28. A jet boss 29 having an opening 30 therethrough is formed at one corner of the dome surface to receive a mud nozzle (not shown). A cylindrical opening 32 is bored through the leg shirttail to form a bearing-pin bore or seat in the leg.

Pin 23 is preferably cylindrical so it can be machined by conventional turning operations. The pin has an inner end 35 defining a thrust button for the mating cutting cone (not shown), and a main journal-bearing surface 36. An annular groove 37 in the pin between the journal-bearing surface and pin inner end forms a portion of the race which receives locking balls when the cone is assembled on the leg and pin. An annular flange 38 of about ⅛-inch axial thickness extends radially outwardly from the pin at the outer end of the journal-bearing portion of the pin. The flange provides a backup body of metal useful when the pin and leg are welded together as described below, and the flange is usually machined off the pin when welding is complete.

An outer or base portion 40 of the pin is preferably cylindrical for ease of machining, and extends outwardly from flange 38 to a sloping end surface 41 which follows but extends slightly beyond the contour of the outer surface of shirttail 28 to compensate for variations in thickness of the shirttail. Preferably, flange 38 has an outside diameter about ¼-inch larger than the diameter of base portion 40 to insure containment of the inner end of the weld. A locking-ball passage 43 extends from end surface 41 to ball-race groove 37, and a grease passage 44 extends laterally from the ball passage to the surface of base portion 40 to mate with a grease passage 45 in the leg as shown in FIG. 3.

The pin and leg are assembled in the position shown in FIG. 3 with the outer face of flange 38 abutted against an inwardly facing flat surface 47 of leg shirttail 28. Preferably, the inside diameter of shirttail opening 32 is no more than about 0.005-inch larger than the outside diameter of base portion 40 so the pin makes a relatively snug fit in the shirttail since no filler metal is to be added. The parts are clamped in this position in a jig which is then mounted in the vacuum chamber of a conventional electron-beam welding machine (not shown).

After the chamber of the welding machine is evacuated, a high-energy electron beam (simulated by dashed line 48 in FIG. 3) is projected into the interface between the shirttail and pin base portion to melt the facing surfaces in the interface zone and weld the parts together. The beam is moved to cover the entire circumference of the interface zone, and the beam energy is varied to control welding depth corresponding to the varying axial length of the zone around the circumference of the pin.

Preferably, the penetration depth (i.e., in the direction of the electron beam) of the weld is extended into flange 38 to insure that the entire interface of the shirttail and bearing-pin base portion are welded together for maximum strength. The approximate location of the inner or terminal end of the weld is indicated by dashed lines 49 in FIG. 3. The presence of flange 38 enables the operator to continue the weld slightly beyond the end of the desired welded interface, rather than attempting to control the electron beam to extend the weld only to the exact end of the interface.

Conventional electronic equipment is used to control the movement, lateral speed, and energy of the electron beam. It is also practical to rotate the assembled parts with respect to a stationary electron beam if desired.

When the welding operation is completed, the vacuum chamber is brought up to atmospheric pressure, and the welded parts are removed for finish machining.

These steps typically involve machining of end surface 41 to be flush with the shirttail outer surface which is also finish machined during the same operation, and a reduction or elimination of flange 38 to avoid interference with the cone, and to provide space for a grease seal such as an O-ring shaft seal. A cutting cone is then mounted on the bearing pin, and assembly of the final bit is completed in conventional fashion. Weld bead penetration into the flange permits the face of the leg adjacent the cone to be smooth and free of welding "drop through" or voids while allowing welding of the entire interface between the leg and bearing pin. Removal of the flange can minimize any notch effects adjacent the base of the bearing pin.

Other forms of energy-beam welding methods such as laser techniques may be used to secure the bearing pin to the leg. Electron-beam welding is presently preferred, however, because machines of this type are commercially available, and apparatus for controlling the motion, energy, and depth of penetration of the electron beam has been developed to a high degree of sophistication.

As compared to prior-art gas or electric-arc welding, electron-beam welding produces a superior bond which extends along the entire axial length of the mating surfaces, but which is narrow and has only a shallow heat-affected zone due to the localized heating which characterizes this welding method. The strength of the alloys at the welded interface may in fact be increased by the vacuum re-melting which occurs during irradiation with the electron beam in a vacuum chamber. No filler metal or flux is required, and the generalized intense heating and warping associated with laying down a heavy deposit of metal by arc-welding methods are avoided.

A number of advantages arise from fabrication of the leg and bearing pin as separate components which are secured together after being machined and heat treated. In the conventional method of making a leg and integral pin from a forging, a large amount of metal must be machined off the forging to form the pin, and heavy machinery and expensive special fixtures are needed to hold the heavy forging during turning of the pin. Grinding of the ball-race groove in the pin is difficult due to the limited clearance between the pin and the domed leg surface above the pin. Concentricity and surface finishes are also difficult to hold to desired tolerances due to the size, weight, and awkward shape of the integral leg and pin, and the unbalance which occurs when the part is rotated.

The separate pin, on the other hand, can be economically and accurately machined between centers from bar stock, and the pin seat in the leg is formed by a simple and accurate boring operation. Grease and locking-ball passages are easily drilled in the pin, and the passages can be finish reamed if necessary after the leg and pin are welded together. Metallurgical flow lines on the separate pin are parallel to the pin axis for greater strength in this part which is subjected to heavy axial and radial loads during rock drilling operations.

A significant increment of factory cost of an integral leg and pin arises from making the entire forging of expensive hardenable high-strength alloy needed for the pin, whereas the separate leg can be made of a less-expensive alloy suited to the operational demands on this part. Many of the heat treating steps can be confined to the pin alone, and "stop off" selective carburization of the leg during pin heat treatment is eliminated. Leg warpage during pin heat treating is avoided, and energy is conserved by heating the relatively small pin as compared to the entire leg and pin. The narrow heat-affected zone arising from electron-beam welding avoids degradation of the heat-treated pin, and hard facing is easier to apply to the separate pin prior to welding. An important reduction in cost and energy consumption results from the elimination of filler metal (welding rod) which is added by conventional gas or arc welding methods.

There has been described a rock-bit segment assembly in which separate leg and pin components are machined and heat treated prior to attachment by electron-beam welding. The assembly is superior to prior-art integral segments, and to separate leg and pin components which are secured together by gas or electric-arc welding which is expensive, inaccurate, and weaker then the narrow but deep and penetrating weld arising from use of electron-beam welding.

What is claimed is:

1. A method for making a leg and bearing-pin assembly for a rock bit, comprising the steps of:

a. forming a rock-bit leg with a shirttail portion having a bore defining a bearing-pin seat;

b. forming a bearing pin with an inner end configured to fit into a cutting cone, a base portion configured to fit into the shirttail bore and mate with the seat, a bearing surface between the inner end and the base portion, and a radially extending annular flange between the base portion and the bearing surface;

c. positioning the bearing pin on the leg with the base portion in the seat and the flange abutting the leg adjacent the seat;

d. irradiating the adjacent surfaces of the seat and bearing-pin base portion with a beam of energy sufficient to penetrate into the flange, and to weld together substantially the entire adjacent surfaces; and e. machining off at least a portion of the flange after the seat and base portion are welded together.

2. The method of claim 1 wherein the adjacent surfaces are welded by electron-beam welding in a vacuum chamber.

3. The method of claim 2, and further comprising the step of carburizing and heat treating the bearing pin prior to welding the pin to the leg.

4. The method of claim 2 wherein the bearing pin and leg are formed of different metal alloys.

5. The method of claim 2 wherein the forming of the leg includes forming the bearing-pin seat as a cylindrical bore in the leg, and the forming of the pin includes forming the pin base portion as a cylindrical surface, the welded interface of the seat and base portion extending entirely around the cylindrical surface.

6. The method of claim 5 wherein the forming of the leg includes forming the cylindrical bore to extend through the leg, and the forming of the pin includes forming the base portion to have an outer end which extends beyond an outer surface of the leg adjacent the seat.

7. The method of claim 6, and further comprising the step of machining the outer end of the base portion to make the outer end substantially flush with the leg outer surface after the seat and base portion are welded together.

* * * * *